United States Patent [19]

Ahrens et al.

[11] Patent Number: 4,491,419

[45] Date of Patent: Jan. 1, 1985

[54] METHOD AND APPARATUS FOR MIXING FINE MATERIAL

[75] Inventors: Norbert Ahrens, Oelde; Helmüt Daniel, Beckum; Gerhard Schacknies, Ennigerloh, all of Fed. Rep. of Germany

[73] Assignee: Krupp Polysius AG, Beckum, Fed. Rep. of Germany

[21] Appl. No.: 498,646

[22] Filed: May 27, 1983

[30] Foreign Application Priority Data

Jun. 29, 1982 [DE] Fed. Rep. of Germany ..... 3224196

[51] Int. Cl.[3] ..... B01F 13/02; B01F 15/02

[52] U.S. Cl. ..... 366/101; 366/137

[58] Field of Search ..... 366/101, 102, 136, 137, 366/341, 106, 107; 222/318, 637; 406/85, 89, 90, 91, 138

[56] References Cited

U.S. PATENT DOCUMENTS

| | | | |
|---|---|---|---|
| 3,172,736 | 3/1965 | Gee et al. | 366/136 |
| 3,334,868 | 8/1967 | Lage | 366/136 |
| 3,661,364 | 5/1972 | Lage | 366/136 |
| 4,042,220 | 8/1977 | Humkey | 366/101 |
| 4,364,665 | 12/1982 | Ahrens et al. | 406/90 |
| 4,382,723 | 5/1983 | Möller | 406/90 |

FOREIGN PATENT DOCUMENTS

| | | | |
|---|---|---|---|
| 1034464 | 7/1958 | Fed. Rep. of Germany | 366/136 |
| 45-3471 | 2/1970 | Japan | 366/136 |

*Primary Examiner*—Philip R. Coe

*Attorney, Agent, or Firm*—Learman & McCulloch

[57] ABSTRACT

A method and apparatus for mixing fine material in which material is extracted from a level located above the cover of a discharge chamber at the base of a mixing silo and returned to the upper part of the silo. Fresh material is delivered to the upper part of the silo, and in a region that is radially inward of that in which the extracted material is returned.

17 Claims, 2 Drawing Figures

METHOD AND APPARATUS FOR MIXING FINE MATERIAL

BACKGROUND OF THE INVENTION

The invention relates to a method and apparatus for mixing fine material using a mixing silo to the upper region of which the material to be mixed is delivered and which contains in the center of the silo base a discharge chamber provided with a cover, the material being pneumatically loosened in the region surrounding the discharge chamber and conveyed to the discharge chamber.

A method and apparatus of the aforesaid type is known for example from German Offenlegungsschrift No. 26 57 597. In practice it has often been found that the material located above the cover of the discharge chamber does not take sufficient part in the mixing process because it is not caught by the discharge funnels formed by the pneumatic loosening arrangements. In order to provide a specific remedy for this, it is already known (see German Offenlengungsschrift No. 26 57 597) to provide an opening with a slide valve in the cover of the discharge chamber so that the material located above the discharge chamber can be introduced through this opening directly into the discharge chamber which also serves as a mixing chamber.

This results in a certain improvement in the homogenising effect, but even such a method still has the fundamental disadvantage that so-called long-term fluctuations of the material to be mixed are not equalised. These are fluctuations in the composition of the raw material, which often occur with a frequency of more than 10 to 20 hours and are not equalised because of the significantly shorter period of dwell of the material in the silo. In order to equalise such long-term fluctuations with the conventional mixing method, the mixing silo would have to be of such a size as to involve extraordinarily high construction costs.

Mixing methods and apparatus are also known (see German Pat. Nos. 635,202 and 669,206) in which in mixing silos of a substantially different type (namely without a discharge chamber provided with a cover in the center of the silo base) the material which is pneumatically loosened in the lower region of the silo is conveyed back to the upper region of the silo and is there delivered again together with the fresh material.

Insofar as these known mixing methods and apparatus can be operated continuously, there is a danger that streams of insufficiently mixed material may pass through to the central discharge because of the absence of a discharge chamber provided with a cover. Also, since the lower inlet nozzles of the uptake pipes are located above the ventilated cross-sectional zones of the silo base, it is preferred in the known method for the material which is already fluidised to be conveyed back to the upper region of the silo, whilst the material in less active zones of the silo participates in the circulation. These known methods are therefore not suitable for equalising long-term fluctuations of the material to be mixed.

The object of the invention, therefore, is to provide a mixing method and apparatus of the class described which effectively suppresses or equalises long-term fluctuations of the material to be mixed with low construction and running costs and in particular without any significant increase in the size of the mixing silo.

This object is achieved according to the invention in that mterial is extracted from the zone of the silo located above the cover of the discharge chamber and delivered back to the upper region of the silo in an outer cross-sectional zone which surrounds an inner cross-sectional zone intended for delivery of the fresh material.

SUMMARY OF THE INVENTION

The invention is based on the knowledge that, in a mixing silo provided in the base region with pneumatic loosening arrangements and a central discharge chamber using the conventional method, the actual mixing effect only succeeds in the loosening zone above the loosening arrangements, but on the other hand a large proportion of the interior of the silo, especially the zone located above the cover of the discharge chamber and the upper layers of the material do not take part in the mixing effect. When, according to the invention, material is extracted from a zone which is deep in the silo but less active (namely above the cover of the discharge chamber) and delivered back to the upper region of the silo, material which has already spent a long time in the silo is brought close to freshly delivered material. This provides an important prerequisite for the equalization of long-term fluctuations without increasing the size of the silo chamber.

In contrast to the prior art referred to above (German Pat. Nos. 635,202 and 669,206), in the method according to the invention the recycled material delivered back to the upper region of the silo is not taken from a base zone which is intensively fluidised by pneumatic loosening arrangements and already participates in the mixing effect. For the method according to the invention it is more important that the material is extracted from a zone of the lower silo region which is less active or even dead from the mixing point of view. In mixing silos which have a central discharge chamber provided with a cover, such a zone is above all the space above the cover in which standing material bridges seldom form. In the method according to the invention the recycled material is advantageously not discharged at random in the upper region of the silo. It has proved advantageous if the recycled material is delivered in an outer cross-sectional zone of the silo which surrounds an inner cross-sectional zone intended for delivery of the fresh material. In the further movement of the material through the silo this facilitates an optimum intermixing of fresh material and recycled material.

According to an advantageous embodiment of the method according to the invention material is extracted from the zone of the silo located above the cover of the discharge chamber in such a quantity per unit of time that a material flow running from the outer material delivery zone in the upper region to the central material extraction zone above the cover of the discharge chamber is produced in the silo and a material flow which runs from the inner material delivery zone in the upper region to the pneumatically loosened zone in the region surrounding the discharge chamber passes through it.

DESCRIPTION OF THE DRAWINGS

The foregoing and other features of the invention are set out in the following description of an embodiment illustrated in the drawings, wherein.

DETAILED DESCRIPTION

Figure 1:
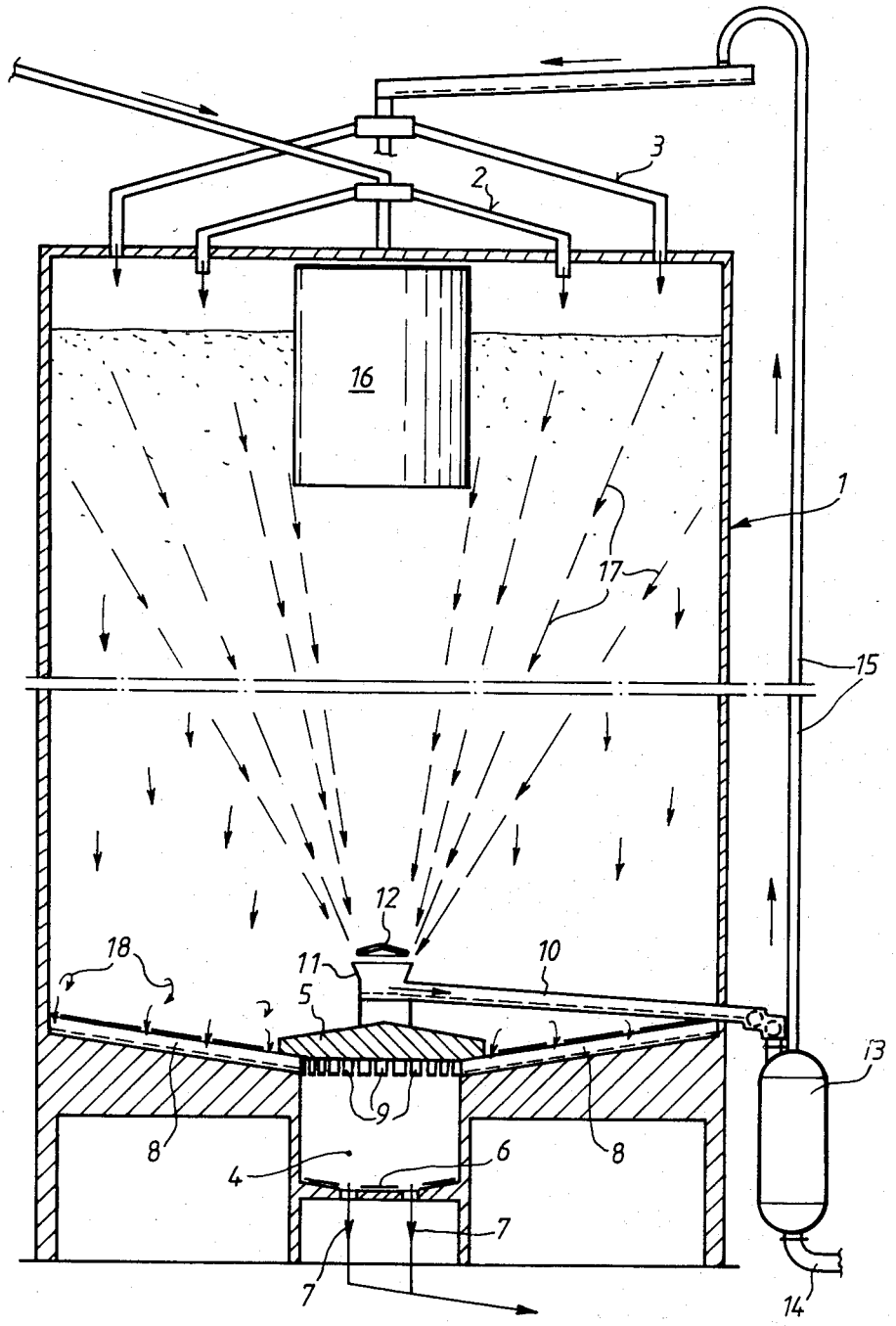
FIG. 1 is a vertical section through a mixing silo according to one embodiment of the invention.

A mixing silo 1 schematically illustrated in FIG. 1 contains in its upper region an inner conveyor manifold 2 for the fresh material to be mixed and an outer conveyor manifold 3 for recycled material. The construction of such conveyor manifolds is known and is therefore not shown in greater detail here. Pneumatically ventilated conveyor troughs which discharge the material at their ends into the interior of the silo extend in a radial direction from a central inlet point.

A discharge chamber 4 which has a cover 5 is formed in the center of the silo base and is provided with known means 6 for base ventilation. The mixed material is discharged from the discharge chamber 4 as indicated by arrows 7.

The region of the silo base surrounding the discharge chamber 4 is provided with known means 8 for base ventilation. The ventilating means 8 take the form of inwardly inclined pneumatic conveyor troughs which are partially covered at the top, and the pneumatically loosened material enters the conveyor troughs at the uncovered points and passes through openings 9 into the discharge chamber 4. The base of the discharge chamber 4 is at a level lower than that of the base of the mixing silo 1.

A pneumatic conveyor trough 10 has an inlet hopper 11 located approximately in the center of the silo cross-section and directly above the cover 5 of the discharge chamber 4. This inlet hopper 11 can be partially covered by a cover 12 supported in known manner. The conveyor trough 10 is advantageously covered over its whole length.

The conveyor trough 10 leads outwards and is inclined downwardly from the interior of the mixing silo 1 and opens into a pneumatic vertical conveyor 13 which is connected to a compressed air line 14 and connected via a pneumatic conveyor pipe 15 to the outer conveyor manifold 3 in the upper region of the mixing silo 1.

Finally, a central cylinder 16 which narrows the cross-sectional region of the silo supplied with material from the two conveyor manifolds 2 and 3 is mounted by suitable means in the upper part of the silo.

The method of operation according to the invention is as follows:

Material is extracted from the silo zone located above the cover 5 of the discharge chamber 4 by the penumatic vertical conveyor 13 via the inlet hopper 11 and the conveyor trough 10, conveyed upwards through the conveyor pipe 15, and returned to the silo via the outer conveyor manifold 3. Thus this delivery to the silo of the recycled material via the outer conveyor manifold 3 takes place in an outer cross-sectional zone which surrounds the inner cross-sectional zone supplied with fresh material from the inner conveyor manifold 2.

A stream of material which is indicated in FIG. 1 by the arrows 17 is formed from the outer recycled material delivery zone to the central material extraction zone (inlet hopper 11 above the cover 5). This material flow, which in an idealised view is approximately conical, is passed through by a second material flow coming from the inner material delivery zone supplied by the inner conveyor manifold 2.

This fresh material thus must of necessity enter the stream of recycled material and be intermixed with it. Thus in statistical distribution for the individual material particles in the mixing zone there are now two possibilites: Either to move with the main flow to the inlet hopper 11, which results in a return to the upper region of the silo, or to enter the peripheral region (arrows 18) which is pneumatically loosened by the aerating means 8 and thus to pass into the discharge chamber 4.

If a sufficiently large quantity of material is extracted via the pneumatic vertical conveyor 13 and via the inlet hopper 11 and the conveyor trough 10, then the average period of dwell of the individual material particles in the mixing silo is thereby lengthened in a desirable manner. If no long-term fluctuations of the raw material are to be taken care of, then if desired the rate of operation of the pneumatic vertical conveyor 13 can be reduced and thus the average period of dwell of the material in the silo can be shortened.

Figure 2:
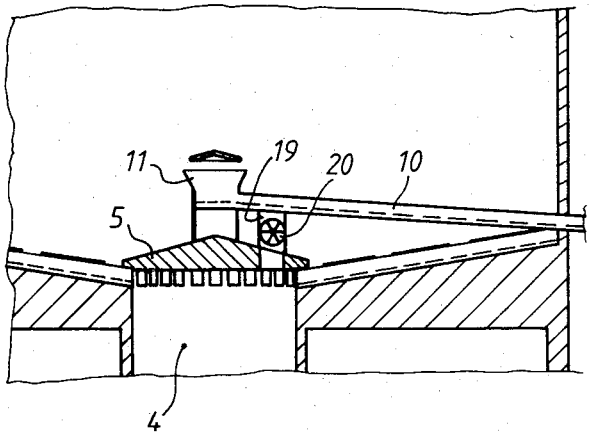
FIG. 2 is a view similar to FIG. 1, but illustrating a modification.

Another possible way of influencing the average period of dwell of the material in the mixing silo within the scope of the method according to the invention is shown in FIG. 2. Here a connecting pipe 19 in which a material valve 20 is located is provided between the conveyor trough 10 and the discharge chamber 4. By appropriate adjustment of the material valve 20 an adjustable proportion of the material extracted from the silo above the cover 5 via the inlet hopper 11 can thus be introduced directly into the discharge chamber 4.

We claim:

1. In a method of mixing fine material in an upright mixing silo wherein material to be mixed is delivered to said silo at its upper end and mixed material is withdrawn from said silo at its base through a discharge chamber located centrally of the base and having a cover, and wherein material in said silo is fluidised, the improvement comprising delivering fresh material to the upper end of said silo in a first region; extracting material from said silo at a level adjacent and above the cover of said discharge chamber; and returning such extracted material to said silo at its upper end and in a second region other than said first region.

2. The method according to claim 1 including extracting said material from said silo at such quantity per unit of time that extracted material returned to said silo passes through and mixes with fresh material delivered to said silo.

3. The method according to claim 1 including collecting externally of said silo material extracted therefrom and pneumatically returning such collected material to said silo.

4. The method according to claim 1 including returning substantially all of the extracted material to said silo.

5. The method according to claim 1 including diverting a selected quantity of the extracted material to said discharge chamber.

6. The method according to claim 1 including extracting material from said silo from a zone inward of both of said regions.

7. The method according to claim 6 wherein said zone is substantially centrally located with reference to the periphery of said silo.

8. In an upright mixing silo having means for introducing fresh material to said silo at its upper end, a discharge chamber in and substantially centrally of its base, said discharge chamber having a cover, and means for aerating said base to fluidise material in said silo, the improvement comprising means for extracting material from said silo at a level adjacent and above said cover;

and conveyor means for returning extracted material to the upper end of said silo, said fresh material and said extracted material being introduced to said silo in different regions of the upper end of said silo.

9. A silo according to claim 8 wherein said extracting means extracts material from said silo from a zone directly above said discharge chamber.

10. A silo according to claim 8 wherein said extracting means delivers extracted material externally of said silo and thence to said conveyor means.

11. A silo according to claim 10 wherein said conveyor means is pneumatic.

12. A silo according to claim 8 wherein the zone at which said fresh material is introduced to said silo is radially inward of the zone at which said extracted material is introduced to said silo.

13. A silo according to claim 12 wherein said material extracting means is substantially centrally located within said silo.

14. A silo according to claim 8 including means for diverting a portion of material extracted from said silo into said discharge chamber.

15. A silo according to claim 14 wherein said diverting means is adjustable to vary the quantity of material diverted to said discharge chamber.

16. A silo according to claim 8 including a block mounted in said silo at the center of the upper end thereof, whereby material at the upper end of said silo presents an annular form.

17. In a method of mixing fine material in a generally cylindrical mixing silo wherein fresh material to be mixed is delivered to said silo at its upper end and mixed with material withdrawn from said silo at its base through a discharge chamber located centrally of the base and having a cover, and wherein material in said silo is fluidised, the improvement comprising delivering fresh material to the upper end of said silo in a first region radially inward of the periphery of said silo; extracting material from a central zone of said silo and at a level adjacent and above the cover of said discharge chamber; and returning such extracted material to said silo at its upper end and in a second region radially outward of said first region, the extraction and return of said material from and to said silo being at such quantity per unit of time that extracted material returned to said silo passes through and mixes with fresh material delivered to said silo.

* * * * *